US007231732B1

(12) United States Patent
Ngan

(10) Patent No.: US 7,231,732 B1
(45) Date of Patent: Jun. 19, 2007

(54) THREE DIMENSIONAL DISPLAY AND POCKET CALENDARS

(76) Inventor: Chi Lung Ngan, 5 Bradford Rd., Edison, NJ (US) 08820

( * ) Notice: Subject to any disclaimer, the term of this patent is extended or adjusted under 35 U.S.C. 154(b) by 386 days.

(21) Appl. No.: 10/872,443

(22) Filed: Jun. 22, 2004

(51) Int. Cl.
*G09D 3/00* (2006.01)

(52) U.S. Cl. ..... 40/107; 40/649; 40/122; 283/2

(58) Field of Classification Search ..... 40/649, 40/775, 537, 107, 122, 119, 121, 118, 115; 283/2; D19/22
See application file for complete search history.

(56) References Cited

U.S. PATENT DOCUMENTS

| | | | | |
|---|---|---|---|---|
| 755,962 | A | 3/1904 | Sullivan | |
| 1,495,953 | A | 3/1924 | Dick | |
| 1,764,236 | A | 6/1930 | Abbott | |
| 1,891,695 | A | 12/1932 | Tatroe | |
| 2,395,191 | A * | 2/1946 | Newman | 40/774 |
| 2,507,697 | A * | 5/1950 | Donow | 40/115 |
| 2,788,595 | A * | 4/1957 | Edwards | 40/107 |
| 3,290,812 | A * | 12/1966 | Hunkins | 40/107 |
| 4,720,123 | A * | 1/1988 | Chelius | 283/2 |
| 4,975,061 | A * | 12/1990 | Avrill | 434/304 |
| 5,033,215 | A | 7/1991 | Newberry et al. | |
| 5,784,814 | A | 7/1998 | Capehart | |
| 5,799,423 | A | 9/1998 | Malino | |
| 5,813,539 | A * | 9/1998 | DePalma | 206/459.1 |
| 6,289,615 | B1 | 9/2001 | Kytlica | |
| 6,657,924 | B2 * | 12/2003 | McCravy | 368/28 |

* cited by examiner

*Primary Examiner*—Gary C. Hoge
(74) *Attorney, Agent, or Firm*—Shlesinger, Arkwright & Garvey LLP

(57) ABSTRACT

A three dimensional display and pocket calendar having first, second and third illustrated portions on the front thereof in which said first illustrated portion depicts a first chronological listing, said second illustrated portion depicts a second chronological listing and said third illustrated portion includes a business advertisement and in which said first chronological listing is a three-dimension raised embossing. The calendar may also include a pocket formed between the front and back sheets which includes windows for displaying information on an insert sheet inserted into the pocket.

3 Claims, 4 Drawing Sheets

THREE DIMENSIONAL DISPLAY AND POCKET CALENDARS

FIELD OF THE INVENTION

This invention relates to calendars having a plurality of chronological listings displayed on the front of the calendar and including a third illustrated portion which is a business adversement or calling card. A pocket for receiving display information can be viewed through the windows of the front and back of the pocket and includes a three dimension front.

BACKGROUND OF THE INVENTION

Early calendars such as Sullivan U.S. Pat. No. 755,962 include an advertising card as well as an illustrated display. Abbott U.S. Pat. No. 1,764,236, Newberry et al. U.S. Pat. No. 5,033,215 and Kytlica U.S. Pat. No. 6,289,615 disclose calendars having pockets for insert of material. Dick U.S. Pat. No. 1,495,953 is illustrative of a binder having a pocket for receiving an insert therein. Tatroe U.S. Pat. No. 1,891,695 provides a transparent cover such as a glass plate through which calendar information can be displayed. Capehart U.S. Pat. No. 5,784,814 and Malino U.S. Pat. No. 5,799,423 show calendars with magnetic means for securing the calendar to a magnetic surface or the like.

OBJECTS AND SUMMARY OF THE INVENTION

It is an object of this invention to provide a three dimensional display calendar which includes a three dimension raised embossing on the front thereof, thereby enhancing the attractiveness and beauty of the calendar for more readily calling attention thereto.

Another object of this invention is to provide a three dimensional display calendar having first and second illustrated portions each having different chronological listings and at least one of which includes a three dimension raised embossing.

A further object of this invention is to provide a display calendar which comprising front and back separate sheets which form together a pocket for an insert which can be viewed from the front and the back since the front and back include windows for viewing the inserts front and back.

A still further object of this invention is to provide a three dimensional display calendar which includes an observable business adversement or calling card insert which may be viewed through a window which may be a cut-out portion or a transparent window.

Yet another object of this invention is to provide a durable plastic calendar which maintains a structurally strong planar position so as to avoid unnecessary creasing or deformation.

Still another object of this invention is to provide a plastic calendar which may be cleaned by a damp rag when dirt defaces the calendar.

Yet another object of this invention is to provide a calendar in which the inserts may contain a menu on one side and advertising information on the other side which can be readily displayed through the windows of the calendar.

Another object of this invention is to provide a calendar in which permits ease in insertion and removal of an informational insert.

Yet a further objection of this invention is to provide a three dimensional display calendar which includes means for mounting on a wall surface including a magnet for mounting on a magnet attracting surface such as on a refrigerator.

These and other objects of this invention may be apparent from the following description including the drawings which are as follows:

DESCRIPTION OF THE DRAWINGS

FIGS. 1–6

In FIGS. 1 and 2, the calendar C includes a front 2 and a back 4. The front 2 has a first illustrated portion 6 which includes a chronological listing 8 such as a the well known Chinese calendar or a zodiac birth date calendar (not shown). A front 2 includes a second illustrated portion 10 depicting a second chronological listing 12 differing from said first chronological listing 8 in general showing an annual calendar depicting the months and days of a specific year. The front 2 includes a third illustrated portion 14 which depicts a calling card which may be a personal or business type calling card or the like. The calling card 16 may be printed or otherwise illustrated on the front 2 as subsequently described.

Figure 1:
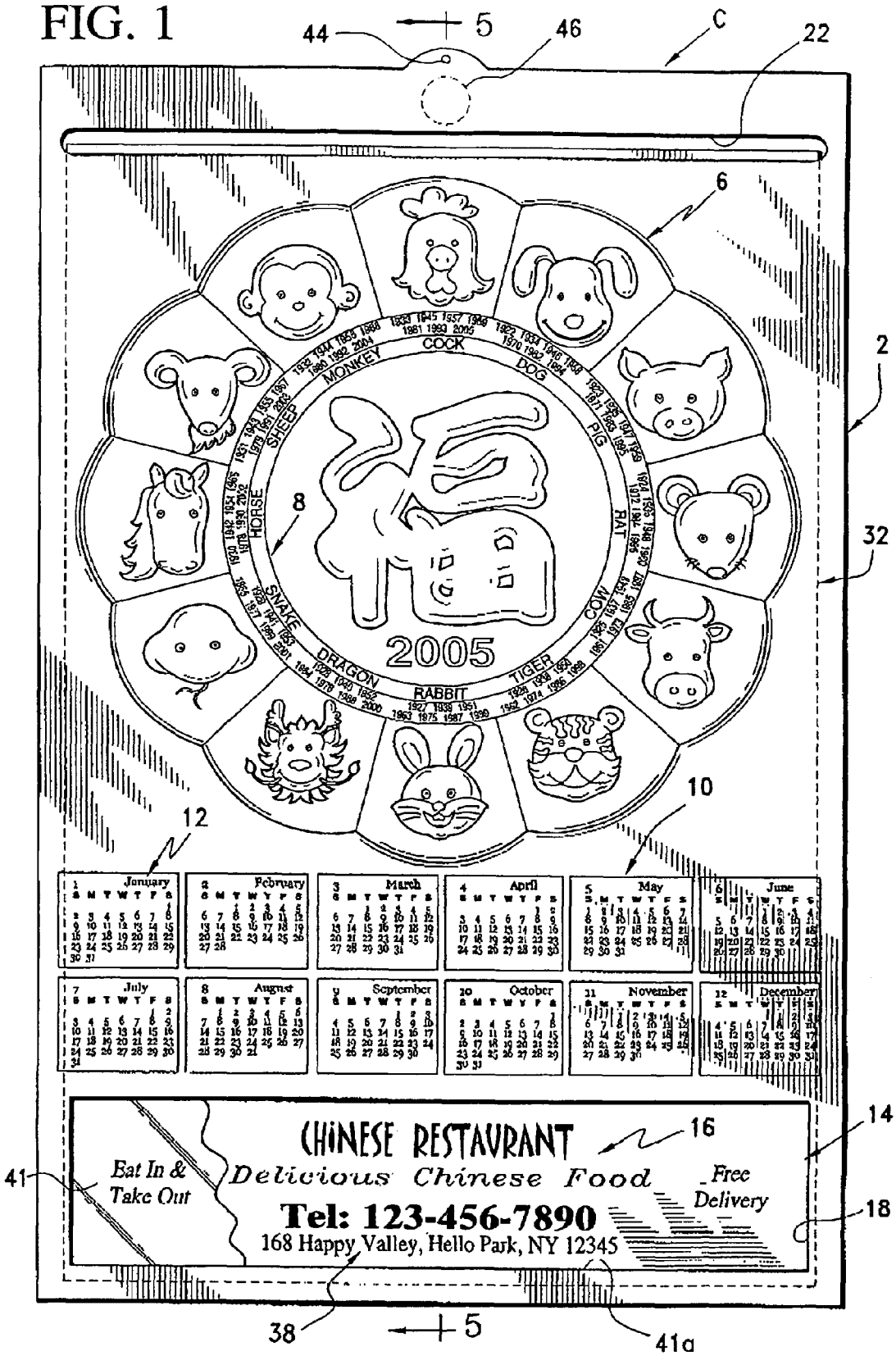
FIG. 1 is a top plan view of the invention.
Figure 2:
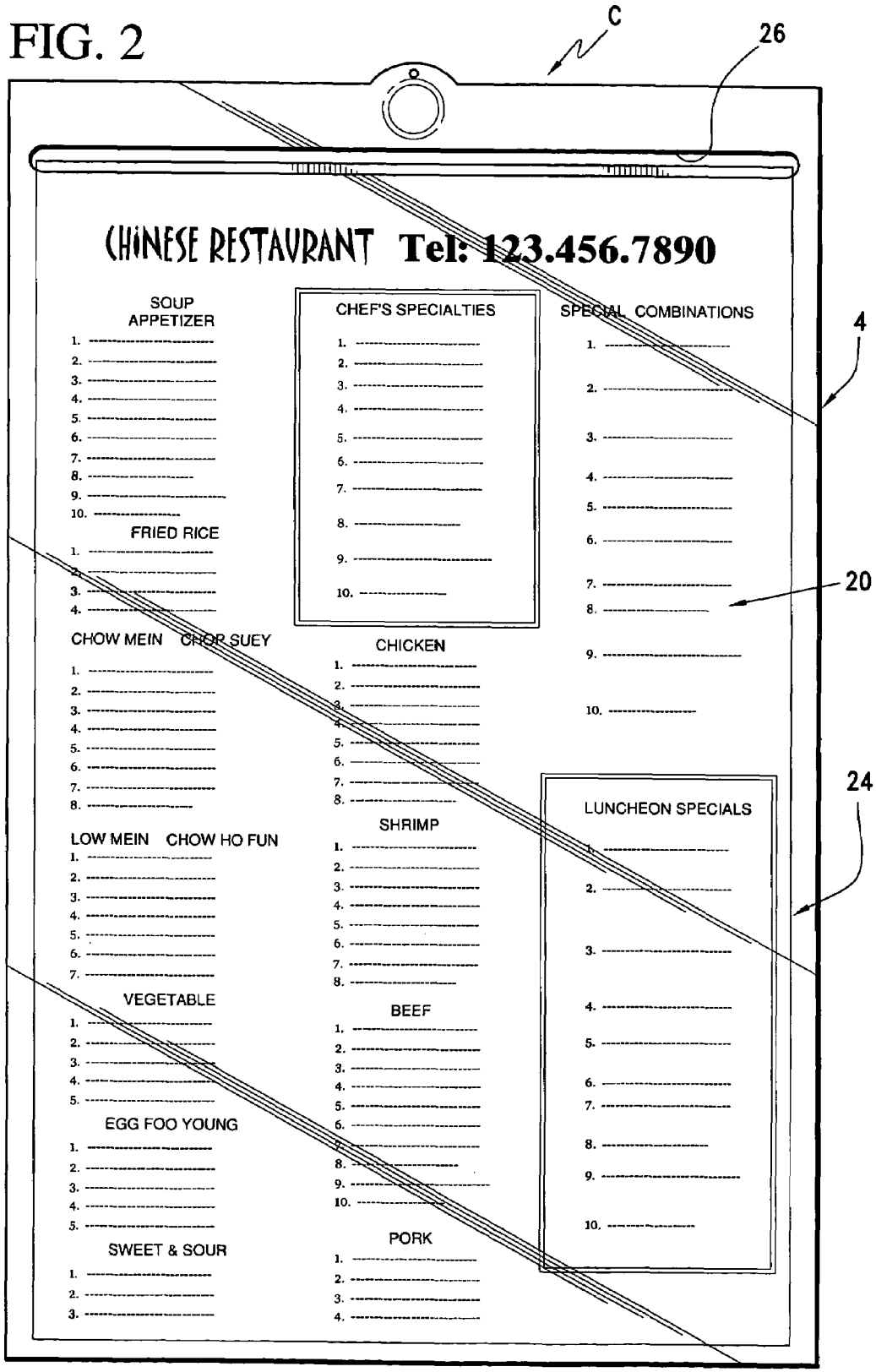
FIG. 2 is a bottom plan view of the invention.
Figure 3:
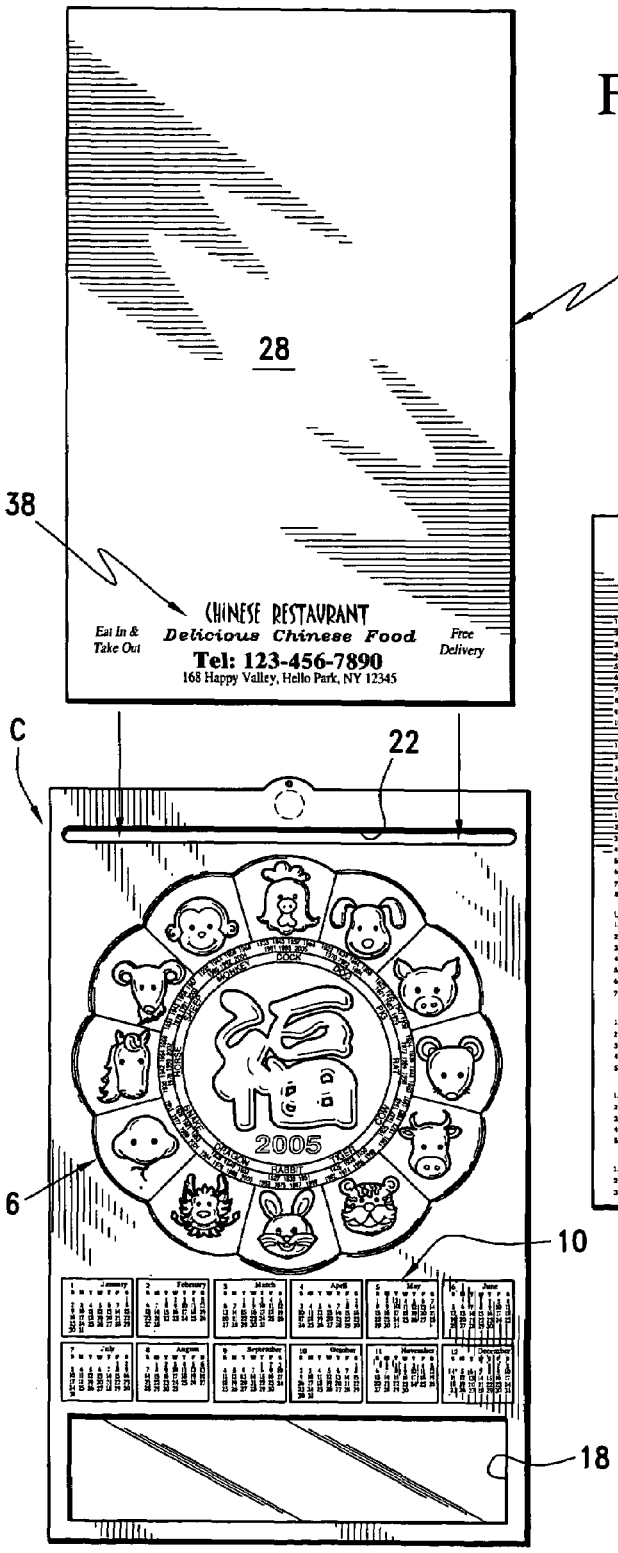
FIG. 3 is a top plan view of the calendar showing an insert about to be inserted in a slot in the calendar and showing the front of the insert.
Figure 4:
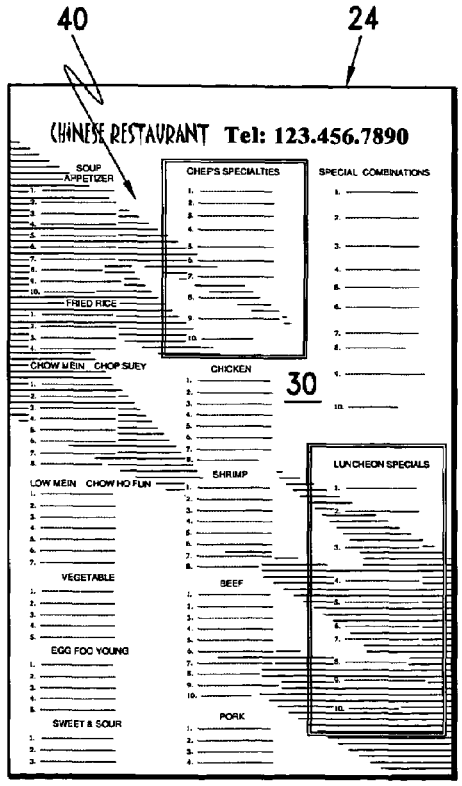
FIG. 4 is a bottom plan view of the insert.
Figure 5:
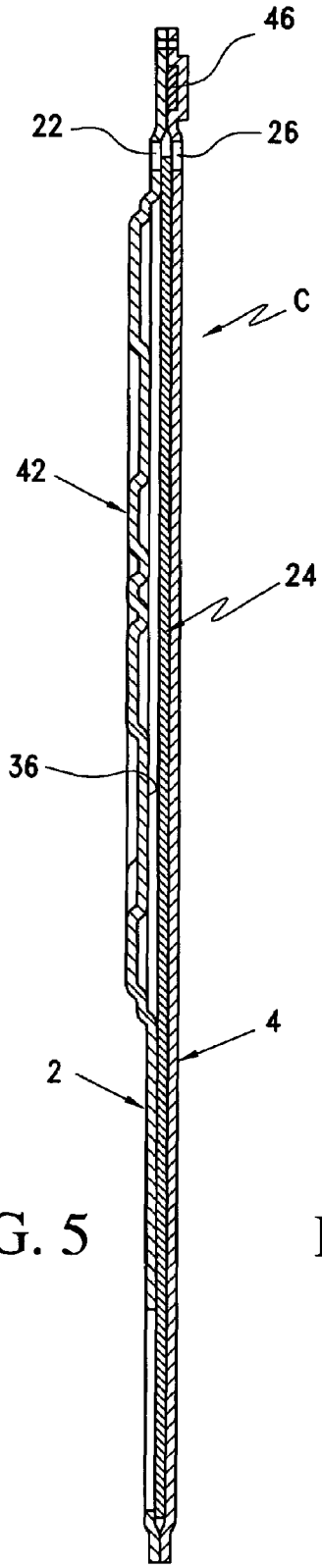
FIG. 5 is a cross-sectional view of the calendar taken along the lines 1—1 of FIG. 1 and viewed in the direction of the arrows and showing the insert in position.
Figure 6:
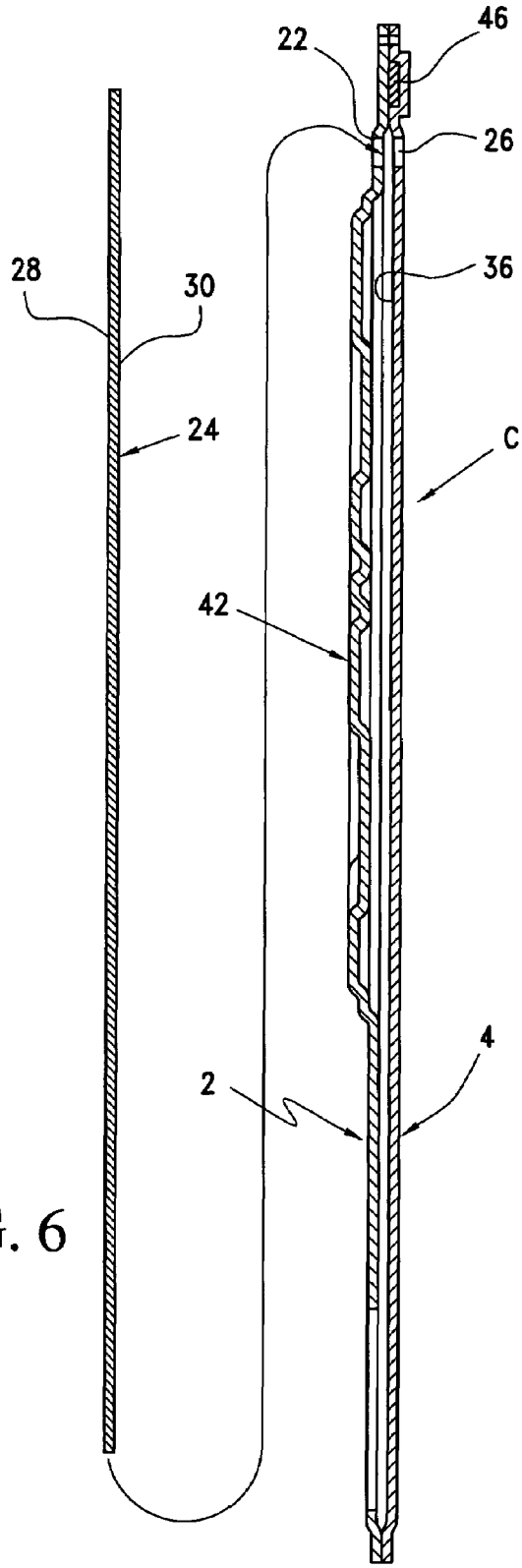
FIG. 6 is a cross-sectional view of the calendar taken along the lines of 1—1 of FIG. 1 and viewed in the direction of the arrows and showing the insert in cross-section with the feed-in-line indicating the position in which the insert is placed in the slot of the calendar.

The back 4 may have printed thereon information pertaining to the calling card business and as illustrated in FIG. 2 may have a restaurant menu printed thereon 20. The front 2 may have a slot 22 for receiving a removable information sheet 24 as illustrated in FIGS. 3 and 4. Instead of the slot 22 being on the front 2, a slot 26 may be provided in the back 4 to receive the removal information sheet 24. The removable information sheet 24 has a front 28 and a back 30 as illustrated in FIGS. 3 and 4. The front 2 and the back 4 may comprise separate sheets of material bonded or otherwise secured at the peripheral edges 32 and 34. The front 2 and the back 4 are plastic sheets of material, energy bonded by radiant energy or ultrasound or the like to form a pocket 36, as best illustrated in FIGS. 5 and 6, for a receipt of the removable information sheet 24. The information sheet 24 includes calling card indica 38 on the front 28 and a menu 40 on the back 30 of the information sheet 24.

The window 18 of the front 2 may be a transparent portion 41 of the plastic front 2 permitting the calling card indicia 38 to be viewed therethrough or it may be a cut-out 41*a* for viewing the calling card indicia 38. The back 4, when it comprises a second sheet bonded to the front 2 to form the pocket 36, will be substantially of transparent plastic permitting the removable information sheet 24 to be viewed therethrough.

It will be noted in FIGS. 5 and 6 that the front 2 first illustrated portion 10 is a three dimensional portion showing raised embossing. At the top of the calendar C is a wall mounting hole 44 hole for a nail or the like for wall hanging. The calendar C is also includes a magnet 46 permitting the calendar to be mounted on a refrigerator or other magnetic type surface.

Although it is preferable that the calendar be made from a plastic material it is possible that other transparent material such as glass compositions or the like may be used.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A display calendar having:

a) a front and a back;

b) said front having first and second illustrated portions;

c) said first illustrated portion depicting a first chronological listing;

d) said second illustrated portion depicting a second chronological listing differing from said first chronological listing;

e) said first chronological listing being a three dimensional and raised embossing;

f) said front and back are sheets secured together forming a pocket for receiving display information;

g) said pocket including a removable intermediate information sheet having a front and back;

h) said back sheet including a transparent section;

i) said information sheet back including indicia visible through said transparent section of back sheet;

j) said front sheet including a window; and k) said information sheet front including indicial visible through said window.

2. A display calendar as in claim 1, and wherein:

a) said window of said front sheet is transparent.

3. A display calendar as in claim 1, and wherein:

a) said window of said front sheet is an opening.

* * * * *